US009892592B2

(12) United States Patent
Finnimore

(10) Patent No.: US 9,892,592 B2
(45) Date of Patent: Feb. 13, 2018

(54) UNIDENTIFIED PLAYER TRACKING SYSTEM AND RELATED METHODS

(75) Inventor: Ian P. Finnimore, Sparks, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 928 days.

(21) Appl. No.: 11/554,504

(22) Filed: Oct. 30, 2006

(65) Prior Publication Data

US 2008/0102935 A1 May 1, 2008

(51) Int. Cl.
*G07F 17/32* (2006.01)

(52) U.S. Cl.
CPC ..... *G07F 17/3248* (2013.01); *G07F 17/32* (2013.01)

(58) Field of Classification Search
USPC ..... 463/25, 29
See application file for complete search history.

(56) References Cited

U.S. PATENT DOCUMENTS

| | | | | |
|---|---|---|---|---|
| 6,554,705 | B1 | 4/2003 | Cumbers | |
| 6,565,434 | B1 * | 5/2003 | Acres | 463/25 |
| 6,612,928 | B1 | 9/2003 | Bradford et al. | |
| 6,676,515 | B1 | 1/2004 | Baltz et al. | |
| 6,783,459 | B2 | 8/2004 | Cumbers | |
| 2002/0077173 | A1 * | 6/2002 | Luciano et al. | 463/25 |
| 2002/0111210 | A1 * | 8/2002 | Luciano et al. | 463/29 |
| 2002/0152120 | A1 | 10/2002 | Howington | |
| 2003/0032474 | A1 * | 2/2003 | Kaminkow | 463/25 |
| 2003/0036425 | A1 | 2/2003 | Kaminkow et al. | |
| 2003/0186745 | A1 * | 10/2003 | Nguyen et al. | 463/42 |
| 2004/0053681 | A1 * | 3/2004 | Jordan et al. | 463/20 |
| 2005/0054439 | A1 * | 3/2005 | Rowe et al. | 463/29 |
| 2005/0124411 | A1 * | 6/2005 | Schneider et al. | 463/29 |
| 2005/0282626 | A1 | 12/2005 | Manfredi et al. | |
| 2006/0160614 | A1 * | 7/2006 | Walker et al. | 463/29 |
| 2007/0054725 | A1 * | 3/2007 | Morrow | G07F 17/3239 463/16 |

(Continued)

FOREIGN PATENT DOCUMENTS

| | | | |
|---|---|---|---|
| GB | 2393015 | A | 3/2004 |
| GB | 2418765 | A | 4/2006 |

(Continued)

OTHER PUBLICATIONS

IGT Gaming Systems—EZPay Ticket System; Copyright 2003.

(Continued)

*Primary Examiner* — Dmitry Suhol
*Assistant Examiner* — Ankit Doshi
(74) *Attorney, Agent, or Firm* — Seed Intellectual Property Law Group LLP

(57) ABSTRACT

Unidentified player tracking systems and related methods of tracking an unidentified player are disclosed herein. According to one method, an unidentified player initiates a first gaming session on a first networked gaming machine, and the gaming activity data during the first gaming session is accumulated. A printed voucher that includes an identification number is issued in response to input from the unidentified player to terminate the first gaming session. The accumulated gaming activity data is then associated with the identification number of the printed voucher, and the identification number of the printed voucher and the associated gaming activity of the unidentified player is stored for future analysis.

7 Claims, 4 Drawing Sheets

(56) References Cited

U.S. PATENT DOCUMENTS

| | | | | |
|---|---|---|---|---|
| 2007/0066398 | A1* | 3/2007 | Rowan | 463/42 |
| 2007/0087834 | A1* | 4/2007 | Moser et al. | 463/42 |
| 2008/0076528 | A1* | 3/2008 | Nguyen et al. | 463/25 |
| 2008/0096650 | A1* | 4/2008 | Baerlocher | 463/30 |

FOREIGN PATENT DOCUMENTS

| | | | |
|---|---|---|---|
| WO | 03/013678 | A1 | 2/2003 |
| ZA | 200403720 | | 7/2005 |

OTHER PUBLICATIONS

Bourie, "Interview with a Slot Manager," *American Casino Guide—1999 edition*, published Nov. 1998, retrieved from http://www.americancasinoguide.com/slot-machines/interview-with-a-slot-manager.html, retrieved on Apr. 20, 2016, 9 pages.

* cited by examiner

UNIDENTIFIED PLAYER TRACKING SYSTEM AND RELATED METHODS

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

Player tracking systems are used to monitor the gaming activities of players on a casino floor. A common method for monitoring casino players is via a player tracking system. Typically, these systems use cards to identify a player. The player inserts the card before playing a game on the casino gaming machine. The player tracking system uses the information stored on the card to identify the player. Once the player tracking system identifies the player, the system then monitors the player's gaming habits. This includes recording player wagered amounts and the rate at which the player plays the games, and the like. Data relating to the player's gaming habits is then stored in a player tracking system database and/or on the player tracking card.

Despite the advantages of using player tracking cards, there are problems associated with the use of such cards. One problem arises when a first player leaves a gaming machine without first retrieving his player tracking card because the player habits of a second player will be attributed to the first player. Another problem occurs when a first player allows a second person to use the first player's tracking card. In this scenario, the first player accrues tracking points that are not actually earned by him as the player tracking system inaccurately records and associates the data as first player information. Yet another problem with player tracking cards is a casino or gaming establishment is only able to monitor the gaming habits of those players who are enrolled in the casino's loyalty (i.e., player's club) program. What is needed is a system and method to non-intrusively track unidentified players during one or more gaming sessions.

SUMMARY

Briefly, and in general terms, various embodiments are directed to methods and systems for tracking the gaming activity of unidentified players. Unidentified players are those players that do not insert a player card (e.g., player tracking card), promotional certificates, credit card, debit card, or inputs information that allows a gaming establishment to identify and track the gaming activity of the player. According to one method, an unidentified player initiates a first gaming session on a first networked gaming machine, and the gaming activity data during the first gaming session is accumulated. A printed voucher that includes a redeemable credit amount and an identification number is issued in response to input from the unidentified player to terminate the first gaming session. The accumulated gaming activity data is then associated with the identification number of the printed voucher, and the identification number of the printed voucher and the associated gaming activity of the unidentified player is stored for future analysis.

Additionally, one method is directed to tracking and enrolling unidentified players into a player loyalty program. The gaming activity data of an unidentified player is accumulated during a first gaming session. A printed voucher including an identification number is issued to an unidentified player in response to player input terminating the first gaming session, and the accumulated gaming activity data is associated with the identification number of the printed voucher. The unidentified player initiates a second gaming session by inserting the printed voucher into a networked gaming machine, and the gaming activity data of the unidentified player is collected during the second gaming session. If the unidentified player has achieved a predetermined performance during the first or second gaming sessions, the unidentified player is presented with an opportunity to join a casino player loyalty program.

In addition to methods of tracking an unidentified player, gaming systems for monitoring unidentified players are also disclosed herein. According to one embodiment, the gaming system includes one or more networked gaming devices that are in communication with a back-end system. The back-end system collects gaming data from unidentified players playing the networked gaming machines, and the back-end system associates the collected gaming data with any printed voucher.

Other features and advantages will become apparent from the following detailed description, taken in conjunction with the accompanying drawings, which illustrate by way of example, the features of the various embodiments.

DETAILED DESCRIPTION

Figure 1:
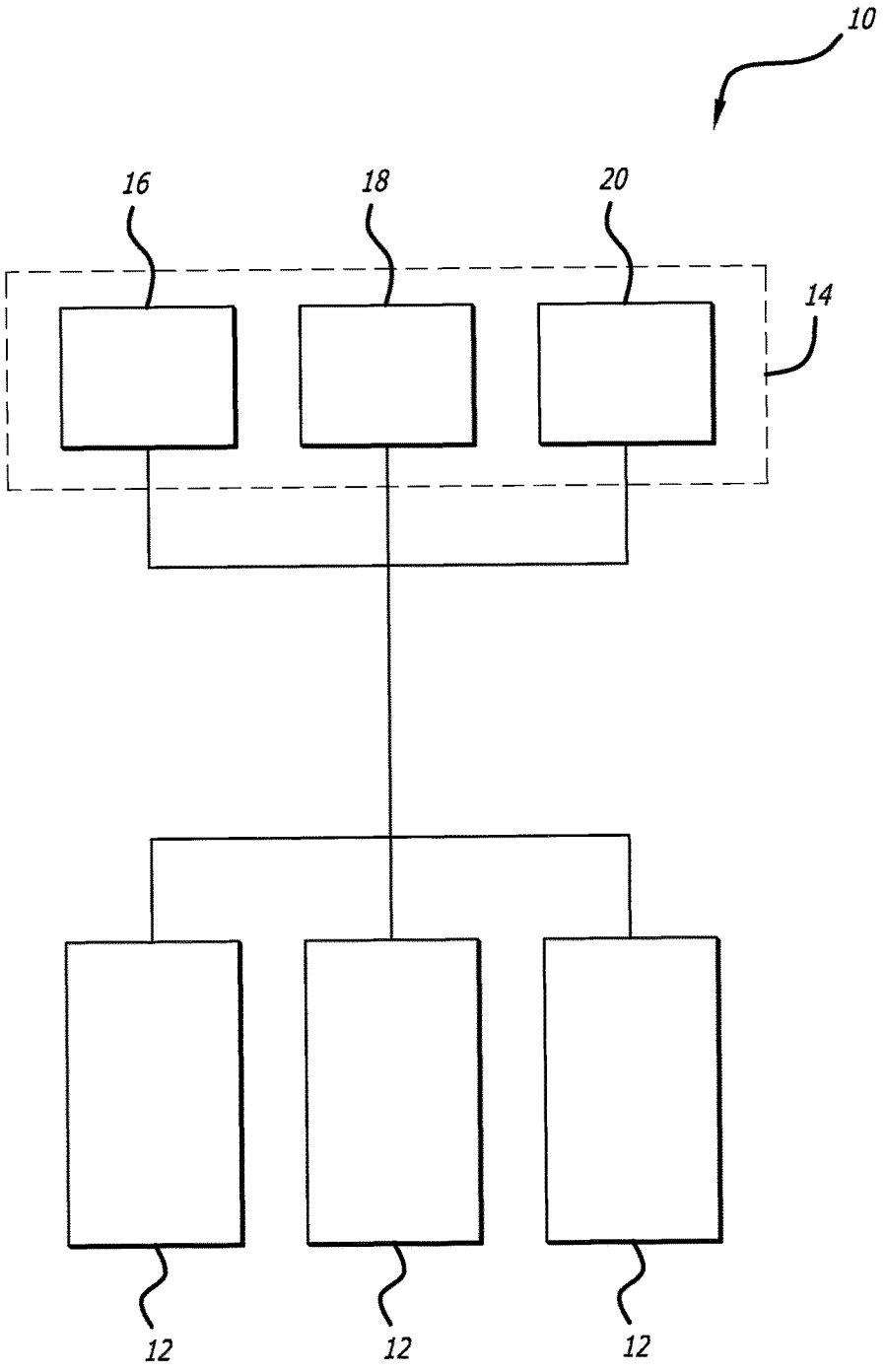
FIG. 1 illustrates one embodiment of a gaming system for tracking unidentified players.

Various embodiments are directed to a gaming system that provides casino operators with the ability to track an unidentified player's activities. Unidentified players are those players that do not insert a player card (e.g., player tracking card), promotional certificates, credit card, debit card, or inputs information that allows a gaming establishment to identify and track the gaming activity of the player. According to one embodiment, the gaming system disclosed herein is able to track an unidentified player's activity by analyzing, at a minimum, the player's ticket-in and ticket-out activity. Ticket-in activities involve the insertion of a voucher or promotional ticket, and the ticket-out activity generally refers to the issuance (i.e., printing) of a voucher or promotional to a player. Generally, the ticket-in activity corresponds to the start of a gaming session and the ticket-out activity corresponds to the end of a gaming session. As a result, the player's gaming habits may be determined by following the player's sequence of ticket-out and ticket-in activities.

Additionally, the ability to track the game play of unidentified players allows a gaming establishment to approach "hot players" in order to enroll these players into the gaming establishment's loyalty program (i.e., frequent play club).

Furthermore, the gaming system may be used to obtain a more complete analysis of traffic flow in a gaming establishment. That is, by combining the gaming activity of both unidentified and identified players, the gaming establishment is able to obtain a more complete data to assess gaming and non-gaming performance (e.g., traffic flow) of a gaming establishment. Based upon the information gathered, the gaming establishment is able to reconfigure a casino floor (e.g., move popular games to unpopular locations) or adjust signage on a casino floor (e.g., remove or adjust the height of signs so players can find particular locations) in order to improve the profitability of the casino floor.

According to one method for monitoring unidentified players, the gaming system tracks unidentified player activity by associating the gaming activity of the unidentified player with ticket-out activity. Player performance is then recursively determined by backtracking through the gaming activity. According to one embodiment, the gaming activity is backtracked to a ticket-in event, and the gaming activity associated with the unidentified player is based upon the ticket-out event and the earliest ticket-in event. In another embodiment, the gaming activity is backtracked to the earliest coin-in event. A coin-in event may be the insertion of currency (coin or bills), debit cards, promotional vouchers, or other forms of credit that may be used to wager on a gaming machine. Alternatively, the gaming activity is backtracked to a period of inactivity having a predetermined length of time. In one embodiment, the predetermined idle period may be three minutes long, but alternate embodiments may cover shorter or longer durations of inactivity at the gaming machine.

According to another method, the gaming system tracks unidentified player activity by starting with gaming session initiating events and ending with a cash-out event. The initiating event is the earliest coin-in event, ticket-in, promotional credit-in, free play, or any other game-initiating event. The cash-out event is the printing of a cash voucher or hand pays for jackpot or progressive wins, or any game-terminating event. For the sake of brevity the cash-out event will be herein referred to as the ticket-out activity (i.e., printing of a voucher).

Once the gaming session has been established (i.e., the initiation and termination of the gaming session), gaming information regarding the gaming session is associated and stored with the ticket-out activity. Gaming information that may be associated with the ticket-out activity includes, but is not limited to, coin-in amount, rate of play, number of maximum bets, duration of the gaming session, average duration of each game, coin-out amount, number of jackpots won, type of games played, or any combination thereof. According to one embodiment, this gaming information is then stored with the serial number or other identifying information associated with the printed cash voucher. According to one embodiment, the accumulated gaming information and the serial number of the printed voucher are stored on a server of the gaming system. Alternatively, this information may be stored on the gaming machine and then transmitted to the gaming system.

According to one method, when the unidentified player later inserts the voucher into the same or different gaming machine, the gaming activity from the subsequent gaming session of the unidentified player is tracked and associated with the previous voucher serial number. In another method, the gaming activity from the subsequent gaming session and any previous gaming sessions of the unidentified player is associated and stored with any new voucher ticket issued to the player. That is, the gaming history associated with each newly printed voucher contains the complete gaming history of the unidentified player. Alternatively, the subsequent gaming history includes a reference (e.g., voucher serial number) to previous gaming activities. In another method, the gaming activity of a particular gaming session is associated with a voucher that terminates the gaming session. Accordingly, multiple gaming sessions by the unidentified player may be associated together after analysis of gaming activity at the server level.

According to another method, gaming information from the unidentified players may be used to target prospective player club members. In this method, the server scans all the active unidentified players and selects the "hot players." The hot players are those unidentified players that are meeting or have exceeded a predetermined performance criteria such as, but not limited to, total coin-in, high rate of play, number of maximum bets, duration of game play, or any combination thereof. According to one method, a program or an extension of existing server systems (e.g. slot management system provided by Bally Technologies, Inc.) may be used to identify prospective members for a casino's player club. As those skilled in the art will appreciate, different software and/or algorithms may be used to identify "hot" players. Alternatively, a gaming machine may transmit a message to a server that a "hot" player is currently playing a gaming session.

Once these hot players have been identified, a notification or message may be sent to a casino representative to approach the hot player in order to enroll the player in the gaming establishment's player club. If the unidentified player does not enroll in the gaming establishment's player club after being approached by a casino representative, the gaming voucher identifier (and/or the related gaming activity) is flagged so that the player is not further disturbed by the gaming establishment. In one method, the hot player that enrolls in the player club may be awarded a prize for previous game play. Additionally, the player's previous game play may be retroactively awarded to the player. Alternatively, the hot player is awarded a prize for merely enrolling into the player club.

In an alternate method, once an unidentified "hot player" has been located, a message may be presented on the gaming machine inquiring whether the player would like to enroll in a player club program. In another method, the message on the gaming machine may be followed-up with a casino representative approaching the player. Accordingly, the player may enroll into the player club on the gaming machine by entering personal data into the gaming machine. Alternatively, the player may enroll by inserting a credit card, driver's license, or other form of identification into the gaming machine.

Optionally, a gift or prize may be offered to the player as an incentive to enroll in the program. For example, the player may be given gaming credits to play on the game in exchange for enrolling the player club. Alternatively, the gaming machine may generate a voucher that is redeemable for a prize such as, but not limited to, cash, merchandise (e.g., a house, car, motorcycle, boat, jewelry, tickets to a show, or the like), services (e.g., vacations, spa packages, golf packages, free hotel rooms, free meals, free drinks), or any combination thereof.

In another method, the unidentified "hot player" may be identified and then awarded for their play. For example, the "hot player" may be given free gaming credits (e.g., place credits on credit meter) or free games. Alternatively, the "hot player" may be awarded by altering the pay pay table (e.g., higher payouts for a given game outcome) or providing additional paylines for a given game. Furthermore, the "hot player" may be awarded vouchers redeemable for cash, merchandise, services, or any combination thereof. As those skilled in the art will appreciate, any award or prize may be awarded to the "hot player" in order to entice the player to continue game play.

In addition to enrolling hot players into a gaming establishment's player club, the gaming activities of unidentified players may be used to monitor and/or analyze traffic flow on a casino floor. More specifically, the ticket-in and ticket-out activity of all unidentified players may be tracked to determine which gaming machines these players have played and at the subsequent gaming machines that the players are playing. The combination of data from unidentified players and those players enrolled in a players' club provides a gaming establishment with a more complete view of traffic flow on a casino floor. That is, the casino is able to track the gaming activity of a large portion of the players in a casino.

For example, tracking data for a printed voucher will include the issuing gaming machine (e.g., game type, game location, or other identifying information) and, optionally, the time in which the voucher was printed. When this voucher ticket is inserted into the gaming machine, the tracking data may be updated and any identifying information associated with the gaming machine used to redeem the voucher is also recorded. Because the identifying information regarding each voucher ticket is stored, the gaming establishment is able to determine the movement of a player by the tracking the issuance and redemption of voucher. For example, the gaming establishment is able to determine if the player returns to the gaming machine that issued the voucher, wagers at another gaming machine, or redeems the ticket at a kiosk or redemption center. Additionally, the movement of an unidentified player may be tracked through multiple gaming establishments (that are commonly owned) by following the ticket-in and ticket-out activity of the unidentified player. Furthermore, the gaming establishment is able to determine the time between issuance and redemption thereby giving the gaming establishment a rough estimate of the time the player moved from one gaming machine to another.

The ability to track a majority of the players' gaming activities on a casino floor allows the gaming establishment to better configure or reconfigure the casino floor. For example, the gaming establishment may be able to determine whether the popularity of a gaming machine is the result of the game itself or the location of the gaming machine. As a result, the gaming establishment may be able to take various actions to improve the profitability of the casino floor. For example, signage may be increased in a particular location on the casino floor. Alternatively, the number or height of the signs may be reduced so that players can find particular locations on the casino floor. The casino may also reconfigure the casino floor by moving popular games in unpopular locations on the casino floor.

According to the various methods, the initiating event for tracking these unidentified players may not always be accurately determined. For example, a second player may begin a gaming session immediately after a first player has left a gaming machine thereby continuing the previous gaming session because the first player did not cash out or the gaming machine did not have sufficient idle time to reset and end the tracking session for the previous player. However, if the idle period is too short, a delay in playing a subsequent game may truncate the tracked gaming session of the unidentified player thereby resulting in inaccurate results. For example, the calculated rate of play of the unidentified player may be artificially high for a short period of time. Another possibility is that a player may initiate another gaming session and not gain the benefit of his/her previous gaming session. However, the tracking of unidentified players gives a gaming establishment some information regarding unidentified players and additional information regarding a casino floor, a particular game, a particular location on the casino floor.

Figure 2:
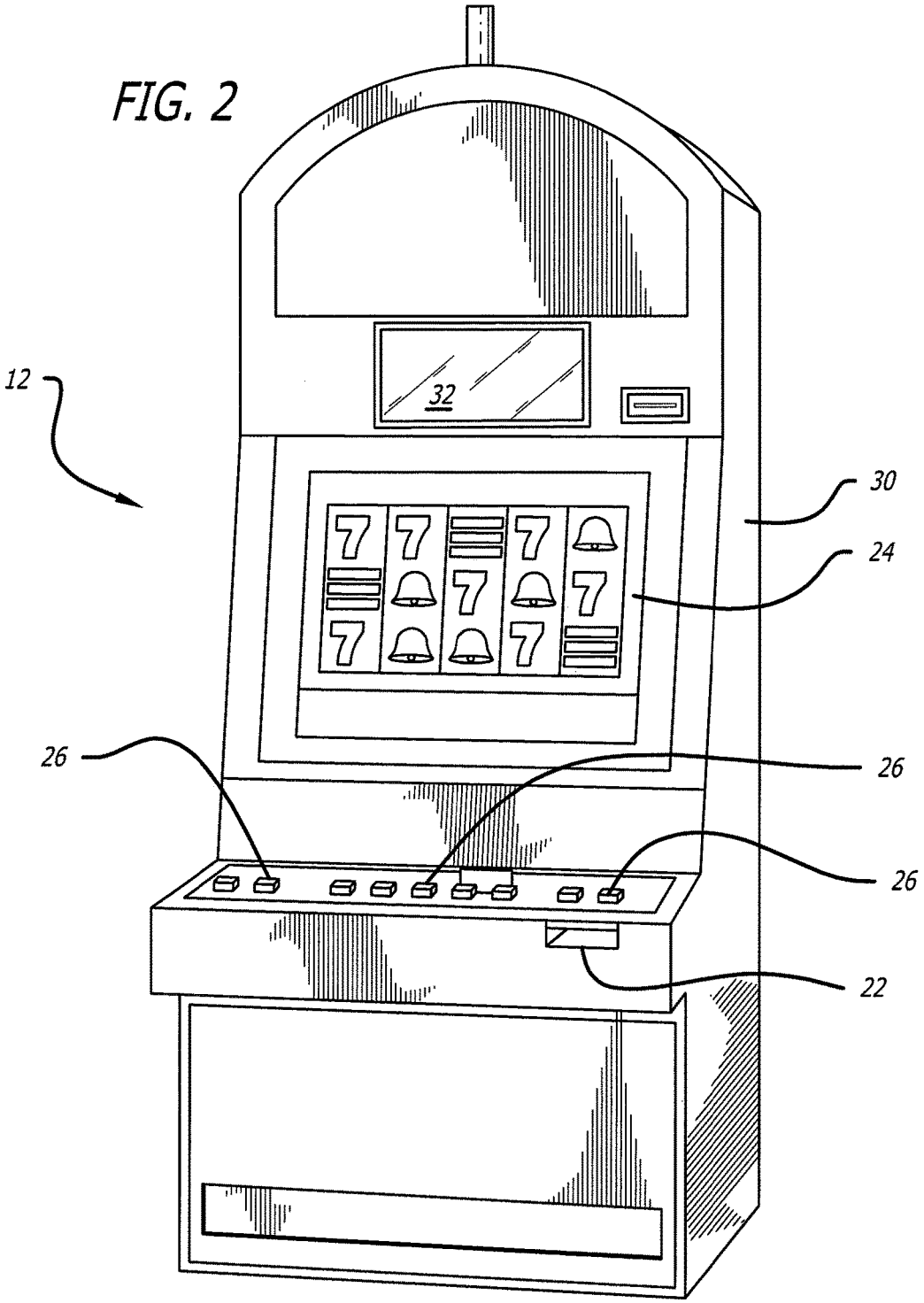
FIG. 2 is a perspective view of one embodiment of a gaming machine.

Referring now to the drawings, wherein like reference numerals denote like or corresponding parts throughout the drawings and, more particularly to FIGS. 1-2, there are shown various embodiments of a system for tracking unidentified players. More specifically, as shown in FIG. 1, the system 10 includes one or more gaming machines 12 that are networked with one or more system servers 14. The gaming machines 12 may be connected to the system servers 14 by a broadband TCP/IP connection, a wireless network connection, or any other means for communicating between components.

According to one embodiment, the gaming system 10 includes a slot management system (SMS) 18, which is a fully integrated accounting database. The SMS 16 manages the networked gaming machines 12 and obtains gaming information, player tracking activity, and employee service activity. For instance, the SMS 16 accounts for and checks bill changer meter integrity, obtains coin out data, and calculates a theoretical percentage for player rating in addition to other analytical and operations functions. Additionally, in one embodiment, the SMS 16 obtains data regarding the gaming activity of an unidentified player (i.e., a player who has not inserted a player card into the gaming machine). The gaming data gathered by the SMS 16 includes, but is not limited to, coin-in values, ticket-in values, ticket-out values, coin-out values, number of maximum wagers, number of pay lines wagered, rate of play (i.e., the number of games played for a predetermined period of time), hand pays, jackpot pays, or any combination thereof and the associated timestamp for any of these events. Based upon these values, the relative performance of an unidentified player may be determined by the SMS 16 or another casino management system or server.

In one embodiment, gaming activity of an unidentified player is tracked at the server level. For example, the SMS 16 captures and updates data from all the networked machines on a real-time basis. Alternatively, the SMS 16 updates data content after a predetermined period of time or after a predetermined triggering event such as a coin-out event or at the end of a gaming session, rather than after each game or on a real-time basis. In another embodiment, gaming activity of the unidentified player is tracked at the gaming machine level, and this information is then transmitted to the server 14. Alternatively, the server 14 will poll the networked gaming machines 12 for gaming activity of unidentified players.

Additionally, in another embodiment, the gaming system 10 includes a player tracking system 18 in communication with the gaming machines 12. The player tracking system 18 allows a casino to monitor the gaming activities of various players. Additionally, the player tracking system 18 is able to store data relating to a player's gaming habits. That is, a player can accrue player points that depend upon the amount and frequency of their wagers. Casinos can use these player points to compensate the loyal patronage of players. For example, casinos may award or "comp" a player free meals, room accommodations, tickets to shows, and invitations to casino events and promotional affairs.

Typically, the player tracking system 18 is operatively connected to one or more input components on the gaming machine 12. These input components include, but are not limited to, a slot for receiving a player tracking card, a keypad or equivalent, an electronic button receptor, a touch screen and the like. The player tracking system 18 may also include a database of all qualified players (i.e., those players who have enrolled in a player rating or point accruing program). Generally, the database for the player tracking system 18 is separate from the gaming machines 12.

The gaming system 10 also includes a cashless gaming system 20 that is in communication with the gaming machines 12. The cashless gaming system 20 includes a ticket printer and ticket reader that is provided on the gaming machine 12. The ticket printer and ticket reader may be separate or integral components. As shown in FIG. 2, the same slot 22 may be used to insert and/or issue a ticket. Alternatively, the ticket reader and the ticket printer have separate slots (not shown) for receiving and issuing tickets, respectively. In one embodiment, the ticket reader (not shown) of the cashless gaming system 20 is capable of accepting previously printed vouchers, paper currency, promotional coupons, or the like. The ticket printer (not shown) of the cashless gaming system 20 generates vouchers having printed information that includes, but is not limited to, the value of the voucher (i.e., cash-out amount) and a barcode that identifies the voucher.

Turning now to FIG. 2, one embodiment of a gaming machine 12 is shown. The gaming machine 12 includes a game display 24, a plurality of player-activated buttons 26, and a player tracking and interactive system gaming device 28 (e.g., iView® display manufactured by Bally Technologies, Inc.) contained within a cabinet 30. The cabinet 30 is a self-standing unit that is generally rectangular in shape. In other embodiments, the cabinet (not shown) may be a slant-top, bar-top, or table-top style cabinet. However, any shaped cabinet may be used with any embodiment of the gaming machine 12.

The game display 24 presents one or more games of chance such as, but not limited to, mechanical slots, video slots, video keno, video poker, video blackjack, video roulette, or Class II bingo. In alternate embodiments, the game display 24 may present games of skill or games of chance involving some player skill. In one embodiment, the game display 24 is a flat panel display including by way of example only, and not by way of limitation, liquid crystal, plasma, electroluminescent, vacuum fluorescent, field emission, LCOS (liquid crystal on silicon), and SXRD (Silicon Xtal Reflective display), or any other type of panel display known or developed in the art. These flat panel displays may use panel technologies to provide digital quality images including by way of example only, and not by way of limitation, EDTV, HDTV, or DLP (Digital Light Processing). The display may have a 4:3 or 16:9 aspect ratio and may be mounted in the gaming cabinet 30 in a portrait or landscape orientation. Additionally, the game display 24 may also include a touch screen or touch glass system (not shown).

In another embodiment, the game display 24 includes a plurality of mechanical reels (not shown). In yet another embodiment, the game display comprises a combination of mechanical reels and video depictions of reels (not shown).

As shown in FIG. 2, the gaming machine 10 includes a plurality of player-activated buttons 26. These buttons 26 may be used for various functions such as, but not limited to, selecting a wager denomination, selecting a number of games to be played, selecting the wager amount per game, initiating a game, or cashing out money from the gaming machine 12. While the buttons 26 shown in FIG. 2 are mechanical buttons, a touch screen system, touch pad, track ball, mouse, switches, toggle switches, or other input means may be used to accept player input. Optionally, in some slot machine embodiments, a handle (not shown) may be "pulled" by a player to initiate a game.

In an alternate embodiment, a cellular phone or other input device (e.g., PDA), separate and apart, from the gaming machine may also be used to input various player choices and information to enhance the player's interactive experience with the gaming system. Furthermore, inputting information via these devices provides an added level of security as any key presses may be hidden from view. In yet another embodiment, a player may call or send a short message service (SMS) to the gaming machine.

Figure 3:
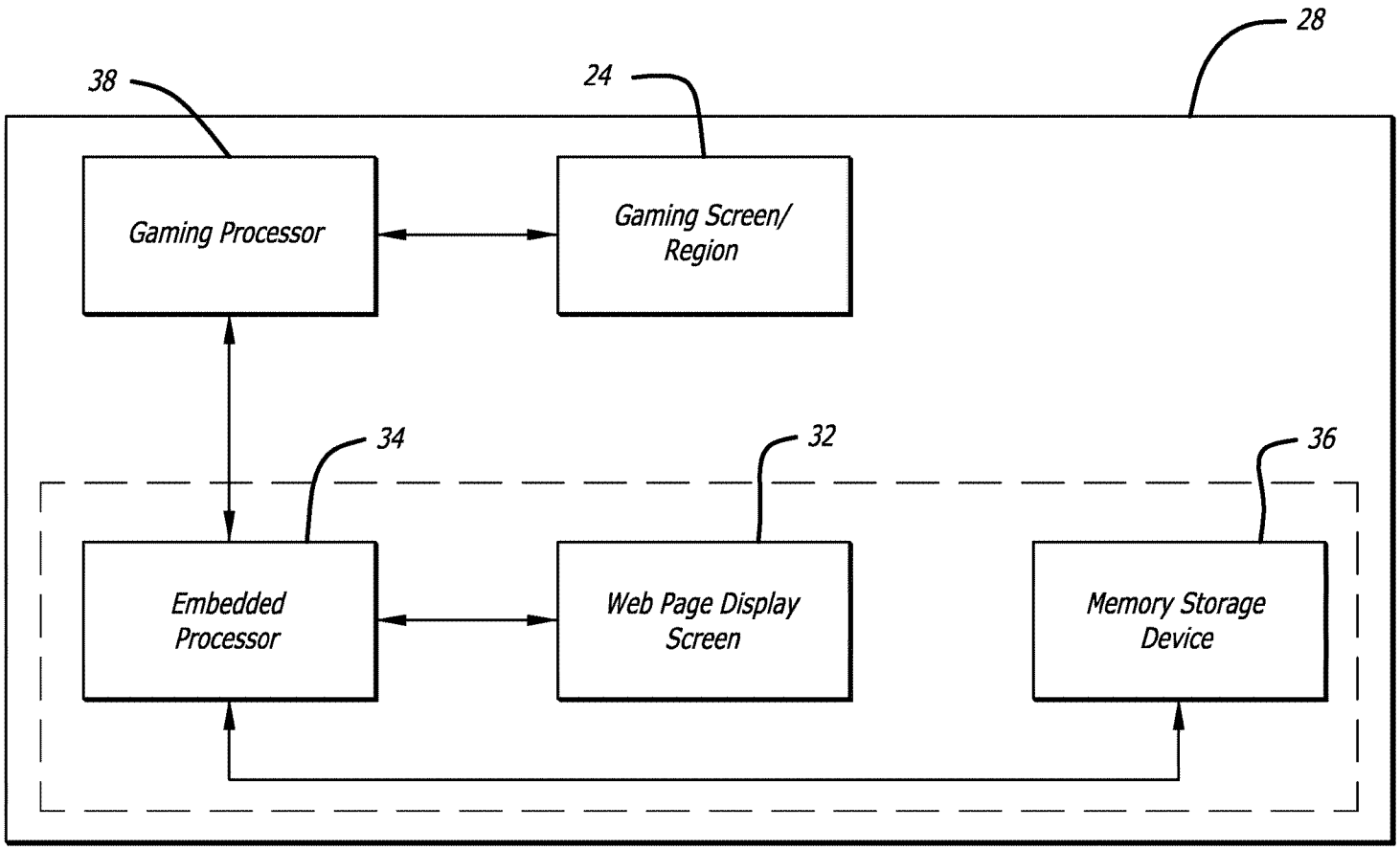
FIG. 3 is a diagrammatic representation of one embodiment of the interactive, system gaming device used in a gaming machine.

FIG. 3 illustrates one embodiment of the interactive, system gaming device 28 that includes a web page display screen 32, an embedded processor 34, and a memory storage device 36. The embedded processor 34 employs an internal operating system and communicates with the gaming processor 38. The embedded processor 34 reads incoming data, translates the data into a web authoring language using a dictionary extension to correlate incoming text strings with URLs or other linked multi-media data, and maps the data to the web page display screen 32. The display screen 32 presents web page information to a user via the display screen, thereby increasing user excitement by providing a richer gaming experience. The GMU (as further described below) monitors the information that is inputted through or displayed on the display screen 32.

In another embodiment, the embedded processor 34 of the interactive, system gaming device 28 may include an expanded device controller (not shown) that communicates with the gaming processor 38, one or more peripheral devices, and one or more back-end systems (not shown. The expanded device controller of the embedded processor 34 includes programming to drive one or more peripheral devices over an interface such as, but not limited to, USB, TCP/IP connection, wireless connection, or the like. According to one embodiment, the peripheral devices may be a touch pad, keypad, trackball, joystick, micro-joystick, coin acceptor, bill acceptor, hopper, printer, and the like.

One of ordinary skill in the art will appreciate that not all gaming machines have all of the previously described components and may have other components in addition to, or in lieu of, those components mentioned here. Furthermore, while these components are viewed and described separately, various components may be integrated into a single unit in some embodiments.

Figure 4:
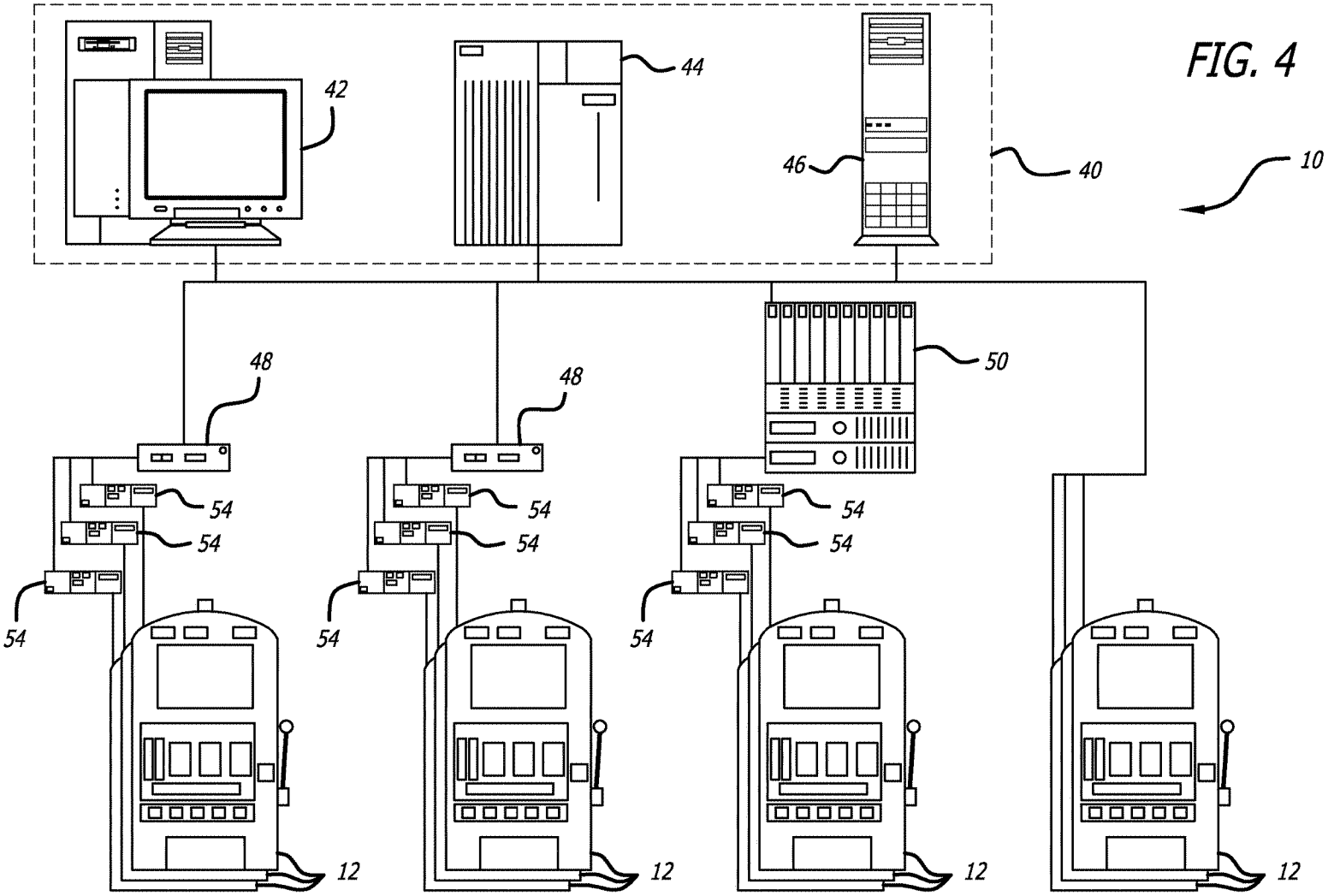
FIG. 4 is a diagrammatic representation of one embodiment of a gaming system that tracks unidentified players.

A variety of types of servers may be included in the gaming system 10. The type of server used is generally determined by the platform and software requirements of the gaming system. Additionally, the gaming system 10 may be configured to comprise multiple servers. In one embodiment, as illustrated in FIG. 4, the gaming system 10 is configured to include three servers. Specifically, servers 42, 44 and 46 form the back-end server system 40, or the back-end servers. In one example, server 42 is a windows based server, server 44 is an IBM RS6000 based server, and server 46 is an IBM AS/400 based server. Of course, one of ordinary skill in the art will appreciate that different types of servers may also be used. The gaming system 10 performs several fundamental functions. For example, the gaming system 10 can collect data (e.g., gaming activity of unidentified players) from the slot floor as communicated to it from other network components and maintain the collected data in its database. The gaming system 10 may use slot floor data to generate a report used in casino operation functions. Examples of such reports include, but are not limited to, accounting reports, security reports, and usage reports. The gaming system 10 may also pass data to another server for other functions. Alternatively, the gaming system 10 may pass data stored on its database to floor hardware for interaction with a game or slot player. For example, data such as a game player's name or the amount of a ticket being redeemed at a game, may be passed to the floor hardware. Additionally, the gaming system 10 may comprise one or more data repositories for storing data. Examples of types of data stored in the back-end server system data repositories include, but are not limited to, information relating to individual player play data, individual game long-term accounting data, cashable ticket data, sound data including optimum audio outputs for various casino settings. Additionally, animation and graphic files may also be stored in the back-end server system data repositories.

The network bridges 48 and network rack 50 shown in FIG. 4 are networking components. These networking components, which may be classified as middleware, facilitate communications between the gaming system 10 and the game management units 52. The network bridges 48 concentrate the many game management units 52 (2,000 on average) into a fewer number (nominally 50:1) of connections to the back-end server system 40. Additionally, the network rack 50 may also concentrate game management units 52 into a fewer number (2000:1) of connections to the back-end server system 40. The network bridges 48 and network rack 50 may comprise data repositories for storing network performance data. Such performance data may be based on network traffic and other network related information.

Optionally, the network bridge 48 and the network rack 50 may be interchangeable components. For example, in one embodiment, a casino gaming system may comprise only network bridges and no network racks. Alternatively, in another embodiment, a casino gaming system may comprise only network racks and no network bridges. Additionally, in an alternative embodiment, a casino gaming system may comprise any combination of one or more network bridges and one or more network racks.

The gaming machines 12 illustrated in FIG. 1 act as terminals for interacting with a player playing a casino game. In various embodiments, any of the gaming machines 12 may be a mechanical reel spinning slot machine, video slot machine, video poker machine, keno machine, video blackjack machine, or a gaming machine offering one or more of the above described games. Additionally, each gaming machine 12 may comprise one or more data repositories for storing data. Examples of information stored by the gaming machines 12 include, but are not limited to, maintenance history information, long-term play data, real-time play data and sound data. The sound data may include, but is not limited to, audio files, sound clips, .wav files, mp3 files and sound files saved in various other formats. Furthermore, each gaming machine 12 comprises an audio system (not shown) for outputting sound. Typically, the audio system comprises one or more speakers, an amplifier, and access to one or more sound files.

Game management units (GMUs) connect gaming machines to network bridges. The function of the GMU is similar to the function of a network interface card connected to a desktop personal computer (PC). Referring to FIG. 4, a GMU 54 connects a gaming machine 12 to the network bridge 48. Some GMUs 54 have much greater capability and can perform such tasks as calculating a promotional cash-back award for a player, generating a unique ID for a cash redeemable ticket, and storing limited amounts of game and transaction based data. Some GMUs 54 may comprise one or more data repositories for storing data. The types of data stored by the GMUs 54 may include, but is not limited to, real-time game data, communication link performance data, real-time player play data and sound data including sound files and audio clips.

In one embodiment, the GMU 54 is a separate component located outside the gaming machine. Alternatively, in another embodiment, the GMU 54 is located within the gaming machine. Optionally, in an alternative embodiment, one or more gaming machines 12 connect directly to a network bridge 48 and are not connected to a GMU 54.

The gaming system 10 may further comprise a slot data system (not shown) stored in one or more data repositories. The slot data system is a computerized accounting and machine monitoring system. Optionally, the gaming system 10 may also comprise a casino management system (not shown). The casino management system provides casinos with a fully integrated, user-friendly software application to manage casino player tracking, promotional, and accounting functions. Features of the casino management system may include player tracking and analysis, table-game management, cage and credit, offer and event management, player club enrollment and redemption, and comprehensive reports and data analysis.

The various embodiments described above are provided by way of illustration only and should not be construed to limit the claimed invention. Those skilled in the art will readily recognize various modifications and changes that may be made to the claimed invention without following the example embodiments and applications illustrated and described herein, and without departing from the true spirit and scope of the claimed invention, which is set forth in the following claims.

What is claimed:

1. A method for monitoring gaming activity from an unidentified player on one or more networked gaming machines, the method comprising:

accumulating gaming activity data from a start of a current gaming session, wherein the current gaming session is started by a receipt of funds from an unidentified player on a first networked gaming machine, each of the one or more networked gaming machines comprising:

(i) at least one display device;

(ii) a plurality of input devices including:

(a) an acceptor of a first physical item associated with a first monetary value;

(b) a cashout button actuatable to cause an initiation of a payout associated with a credit amount;

(iii) at least one gaming machine processor; and (iv) at least one gaming machine memory device storing a game program;

issuing a dual function printed cashout voucher in response to player input from the unidentified player to terminate the current gaming session, wherein the dual function printed cashout voucher includes a redeemable credit amount and an identification number that is issued in response to input from the unidentified player to terminate the current gaming session and that is associated with accumulated gaming activity data, wherein a complete gaming history of the unidentified player is printed on each dual function printed cashout voucher;

associating the accumulated gaming activity data with the identification number of the dual function printed cashout voucher;

after receiving player input requesting issuance of the dual function printed cashout voucher, calculating player performance from the start of the current gaming session;

storing the identification number of the dual function printed cashout voucher and the associated gaming activity of the unidentified player for the current gaming session with any previous gaming activity associated with the identification number from a previous gaming session, wherein the dual function printed cashout voucher is redeemable for a credit amount from cashing out game credits and is also redeemable for awards associated with the accumulated gaming activity data of the unidentified player that are associated with the identification number.

2. The method of claim 1, further comprising:

receiving the dual function printed cashout voucher on a second networked gaming machine;

initiating a subsequent gaming session by the unidentified player on the second networked gaming machine;

accumulating gaming activity data from the subsequent gaming session for the unidentified player, wherein the gaming activity data is accumulated without requiring the unidentified player to insert a player card or to input information;

issuing a second printed cashout voucher in response to player input from the unidentified player to terminate the subsequent gaming session;

associating the gaming activity data from the subsequent gaming session with the identification number of the second printed cashout voucher; and storing the associated gaming activity data from the subsequent gaming session and the identification number of the second printed cashout voucher.

3. The method of claim 2, further comprising:

consolidating the gaming activity data from the multiple gaming sessions, wherein the gaming activity data from a first gaming session is associated and stored with the identification number of a second printed cashout voucher.

4. The method of claim 2, further comprising determining the unidentified player's performance from the subsequent gaming session.

5. The method of claim 4, wherein determining the unidentified player's performance includes calculating player performance from multiple gaming sessions.

6. The method of claim 2, further comprising analyzing the movement of the unidentified player by determining the duration of the gaming sessions and the duration of time between the gaming sessions.

7. A method for monitoring gaming activity from an unidentified player on one or more networked gaming machines, the method comprising:

accumulating gaming activity data from a start of a current gaming session, wherein the current gaming session is started by a receipt of funds from an unidentified player on a first networked gaming machine, each of the one or more networked gaming machines comprising:

(i) at least one display device;

(ii) a plurality of input devices including;

(a) an acceptor of a first physical item associated with a first monetary value;

(b) a cashout button actuatable to cause an initiation of a payout associated with a credit amount;

(iii) at least one gaming machine processor; and (iv) at least one gaming machine memory device storing a game program;

issuing a dual function printed cashout voucher in response to player input from the unidentified player to terminate the current gaming session, wherein the dual function printed cashout voucher includes a redeemable credit amount and an identification number that is issued in response to input from the unidentified player to terminate the current gaming session and that is associated with accumulated gaming activity data, wherein a complete gaming history of the unidentified player is printed on each dual function printed cashout voucher;

associating the accumulated gaming activity data with the identification number of the dual function printed cashout voucher;

after receiving player input requesting issuance of the dual function printed cashout voucher, calculating player performance from the start of the current gaming session;

storing the identification number of the dual function printed voucher and the associated gaming activity of the unidentified player for the current gaming session with any previous gaming activity associated with the identification number from a previous gaming session, wherein the dual function printed cashout voucher is redeemable for a credit amount from cashing out game credits and is also redeemable for awards associated with the stored gaming activity of the unidentified player that are associated with the identification number.

* * * * *